US005243743A

United States Patent [19]

Peterson

[11] Patent Number: 5,243,743

[45] Date of Patent: Sep. 14, 1993

[54] APPARATUS FOR MAKING CUPS

[76] Inventor: Manfred J. Peterson, P.O. Box 707, Palmer, Ak. 99645

[21] Appl. No.: 917,196

[22] Filed: Jul. 22, 1992

[51] Int. Cl.[5] ..... B21D 51/54

[52] U.S. Cl. ..... 29/1.3; 72/344; 72/347

[58] Field of Search ..... 72/344, 345, 347; 29/1.22, 1.23, 1.3, 1.31, 1.32; 86/10

[56] References Cited

U.S. PATENT DOCUMENTS

| | | | |
|---|---|---|---|
| 36,449 | 9/1862 | Boekel . | |
| 425,255 | 4/1890 | Richardson | 72/344 |
| 612,277 | 1/1899 | Campbell | 72/344 |
| 841,954 | 1/1907 | Frank . | |
| 996,820 | 7/1911 | Wray . | |
| 1,203,124 | 10/1916 | Lyon . | |
| 1,718,107 | 6/1929 | Bond . | |
| 2,345,863 | 4/1944 | Whipple . | |
| 2,350,491 | 6/1944 | Butler et al. . | |
| 2,360,354 | 10/1944 | Lyon . | |
| 2,451,488 | 10/1948 | Huntington . | |
| 2,791,137 | 5/1957 | Jones | 72/344 |
| 2,825,259 | 3/1958 | Novak . | |
| 2,851,979 | 9/1958 | Chatfield | 72/344 |
| 2,898,668 | 8/1959 | Frost . | |
| 3,233,304 | 2/1966 | Hettes et al. . | |
| 4,129,024 | 12/1978 | Deveney . | |
| 4,492,010 | 1/1985 | Ramage . | |

FOREIGN PATENT DOCUMENTS

| | | | |
|---|---|---|---|
| 1139537 | 2/1985 | U.S.S.R. | 72/344 |

*Primary Examiner*—Joseph M. Gorski

[57] ABSTRACT

A forming machine for making shallow cups is provided. It has a cylindrical secondary form with a top surface adjacent to which a blank may be positioned. The secondary form is spring-mounted so that it can move during the forming operation. The pressure applied by the spring to the form is adjustable. A forming punch presses the blank, and in turn the secondary form, and moves them further into a body member so that the blank is formed into a shallow cup with the sidewall of the cup positioned around the forming punch.

2 Claims, 1 Drawing Sheet

FIG. 1
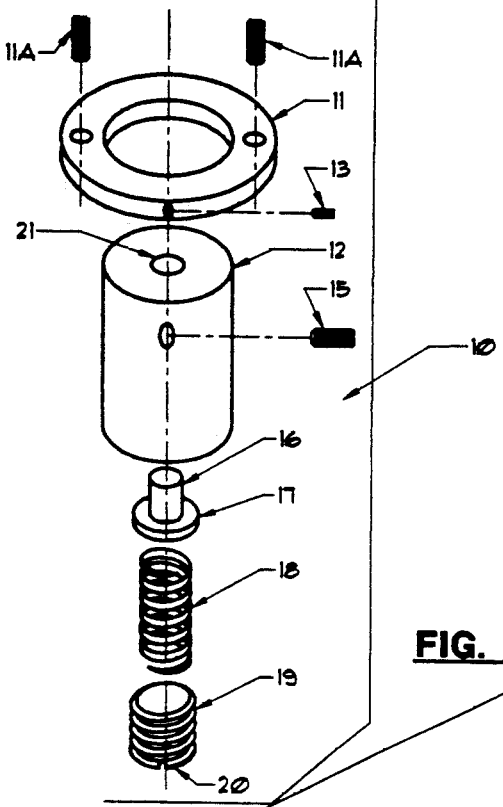
FIG. 2
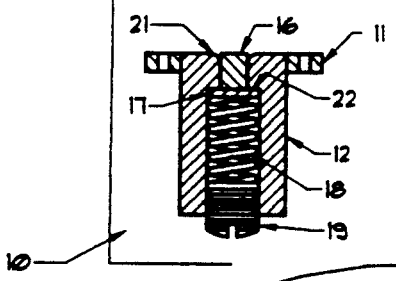
FIG. 3
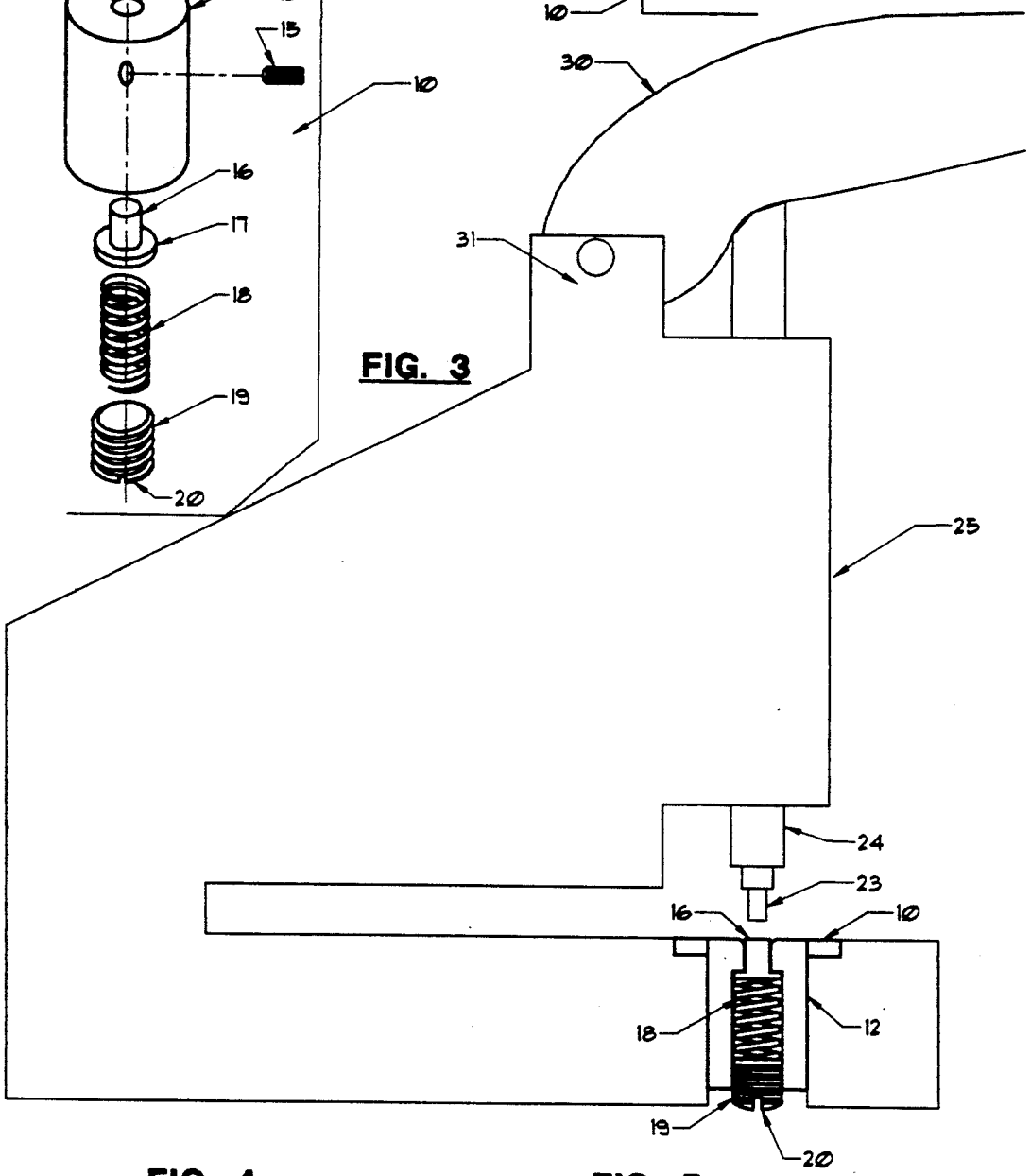
FIG. 4
FIG. 5

APPARATUS FOR MAKING CUPS

BACKGROUND OF THE INVENTION

It is well known in the art of bullets for rifles that a gas check may be placed on the rear end of a bullet to protect the bullet from the adverse effects of the explosion that propels the bullet. One form of gas check is a cylindrical sleeve over a limited length of the bullet at its rear end. Another form of gas check, actually on the market, is known as the Hornady gas check. It is essentially a shallow metal cup wherein the free end of the side wall of the cup is enlarged. After the aforesaid Hornady gas check is applied to the rear end of the bullet there is a sizing step which forces the free end of the cup into the surface of the bullet; that is there is a wedge-shaped projection at the free end of the shallow cup that has actually pierced the surface of the bullet.

Patents showing bullets with some form of gas check include Boekel U.S. Pat. No. 36,449, of Sep. 16, 1862; Wray U.S. Pat. No. 996,820 of Jul. 4, 1911; Whipple U.S. Pat. No. 2,345,863 of Apr. 4, 1944; Frost U.S. Pat. No. 2,898,666 of Aug. 11, 1959; Hettes et al. U.S. Pat. No. 3,233,304 of Feb. 8, 1966; Deveney U.S. Pat. No. 4,129,024 of Dec. 12, 1978; and Ramage U.S. Pat. No. 4,492,010 of Jan. 8, 1985. Of these patents Hettes and Ramage, along with Bond and Novak U.S. Pat. Nos. 1,718,107 and 2,825,259, respectively, disclose lever operated swaging or pressing mechanisms for resizing, reloading or applying a gas check to a bullet.

Other patents teach forming thimbles, caps or cartridge cases from a cylindrical disc. These patents include Frank U.S. Pat. No. 841,954 of Jan. 22, 1907; W. T. Lyon U.S. Pat. No. 1,203,124 of Oct. 31, 1916; Butler U.S. Pat. No. 2,350,491 of Jun. 6, 1944; and G. Lyon 2,360,354 of Oct. 17, 1944.

SUMMARY OF THE INVENTION

This invention provides a stamping machine for making shallow cups. In its preferred form the invention provides a small, hand-operated machine for forming gas checks.

The invention employs a body member (preferably carried by an outer support) with a cylindrical hole in it. Slidable in said hole is a cylindrical secondary form whose outside diameter is only slightly smaller than the diameter of said hole so that the secondary form may move up and down in said hole.

A coil spring, preferably in the form of a helix, presses upwardly on the secondary form and allows that form to move downwardly to a limited extent during the operation of the stamping operation. The inner wall of the body member has a ledge that limits the upward movement of the second form.

An adjusting screw has threads that mate with threads on the inner wall (the wall that defines said opening) of the body member. The screw will vary the pressure that the spring applies to the secondary form, as desired.

The body member has an indent for receiving a blank, which when shaped by the machine, forms the gas check. The screw may move the secondary form to the proper position relative to the indent when the device is operated to produce the gas check.

A forming punch moves vertically to engage a blank in the body member for bending the blank around the forming punch, to produce the shallow cup or gas check.

BRIEF DESCRIPTION OF THE DRAWINGS

FIG. 1 is an exploded view of the body member, secondary form, etc., which may be used for making a shallow cup.

FIG. 2 is a cross-section of the parts of FIG. 1, when assembled.

FIG. 3 is an overall view of the forming machine including the parts of FIG. 1.

FIG. 4 is a side view of a round blank which will be bent into the shape of a shallow cup by the machine of FIG. 3.

FIG. 5 is a cross-section view of the blank of FIG. 4 after the blank has been made into a shallow cup or gas check.

DETAILED DESCRIPTION OF THE INVENTION

This invention provides a small machine that a hunter or other person using a rifle or other firearm may use, to quickly and easily produce gas checks. Moreover, the blanks (FIG. 4) which may be used to make gas checks may be obtained by taking the usual soft drink can (which holds 12 fluid ounces) and, with a conventional hand operated punching machine, punch the blanks from the side wall of the can.

The forming machine comprises the parts 10, 23 and 24 which will be described in detail below.

The outer support 11 is part of the frame of the machine and may have holes such as 11*a* to permit it to be fastened, with bolts, to the remainder of the frame 25. The overall size of frame 25 is about the same as the size of a hand-held stapler used in offices to staple sheets of paper together. The outer support 11 has a central opening for receiving the other parts of FIGS. 1 and 2. The function of the outer support is that it permits body members, such as part 12, to be inserted in it and held by bolts 13 via holes 14 and 15. Several body members, such as 12, of different internal dimensions, to enable shallow cups (gas checks) of different sizes to be produced may be used in the outer support 11.

A secondary form 16 with a base 17 may move up and down in the central opening that is in body member 12. The diameter of base 17 is slightly less than the diameter of the central opening in body member 12 so that the base 17 will freely slide in the body member 12. The body member 12 has a ledge 22 for limiting the upward movement of base 17. The diameter of the central opening in body member 12 is smaller, above the ledge 22, than it is below that ledge. Above ledge 22 the secondary form 16 makes a sliding fit in the form 12, except that at the very upper end of form 12 there is an indent 21 having a diameter slightly greater than the diameter of the blank of FIG. 4.

A helical spring 18 is fastened on the upper end of adjustment means 19. Adjustment means 19 is a cylindrical member having threads that mate with internal threads on the wall of the central opening in body member 12. The adjustment means enables the pressure that the helical spring 18 applies to base 17 to be adjusted. It also provides an adjustable stop for the downward travel of 16, thus allowing the operator to precisely control the amount of flare to the walls of the resulting shallow cup (FIG. 5).

The forming machine 25 has a hand-operated vertically movable member 24 that has a forming punch 23 shaped to convert a blank, positioned in indent 21, into a shallow cup. A handle 30, pivoted at 31, may be pressed downwardly, by hand, to move member 24 to form a blank (FIG. 4) into a shallow cup (FIG. 5). The upper (free) end of secondary form 16 determines the shape of the bottom of the shallow cup. In this case that shape is flat.

OPERATION

To operate the machine to make shallow cups (gas checks), a blank of FIG. 4 is placed on the top surface of secondary form 16, and in the indent 21 that is in the top portion of body member 12. The member 24 is then moved by hand downwardly with great force so that forming punch 23 engages the blank (FIG. 4) and causes a limited portion of the blank, adjacent its periphery, to bend upwardly around the forming punch 23, and produce the sidewall of the shallow cup of FIG. 5.

The helical spring 18 allows the secondary form 16 to move downward, while the blank is being formed into a shallow cup. The amount of pressure applied to the base 17 by the helical spring 18 may be adjusted by rotating adjustment means 19. That adjustment means 19 may have means on its lower end to permit the adjustment means to be easily rotated, for example a slot 20 may be formed to permit the adjustment means 19 to be rotated by a screwdriver. After the blank of FIG. 4 has been formed into the shallow cup of FIG. 5, the spring 18 ejects the shallow cup from the hole in body member 12. The upper end of the hole in body member 12 may be shaped (as shown in FIG. 3) to provide flare to the side wall of the resulting shallow cup.

I claim to have invented:

1. An apparatus for forming a thin metal blank into a shallow cup, comprising:

a body member having first and second ends, an indent at said first end forming a seat in said body member, an inner wall defining a cylindrical opening extending from said second end into said indent, and a screw thread on said inner wall at said second end;

a secondary form slidably received within said cylindrical opening, said secondary form having a first end extending into said indent and a second end located within said cylindrical opening;

a spring located within said cylindrical opening, said spring supporting said secondary form;

adjusting means for adjusting the force that the spring exerts against said secondary form, said adjustment means being threadably engaged with said screw thread and supporting said spring; and a forming punch movable toward and into said indent.

2. The apparatus of claim 1, wherein said indent is a circular depression in said body member, and said secondary form comprises a cylindrical member such that an annular recess exists in said indent around said secondary form.

* * * * *